United States Patent [19]

Chutjian et al.

[11] Patent Number: 4,649,278

[45] Date of Patent: Mar. 10, 1987

[54] GENERATION OF INTENSE NEGATIVE ION BEAMS

[75] Inventors: Ara Chutjian, La Crescenta; Otto J. Orient, Duarte; Samuel H. Aladzhadzhyan, Glendale, all of Calif.

[73] Assignee: The United States of America as represented by the Administrator of the National Aeronautics and Space Administration, Washington, D.C.

[21] Appl. No.: 729,768

[22] Filed: May 2, 1985

[51] Int. Cl.[4] ..... H01J 27/02

[52] U.S. Cl. ..... 250/423 R; 250/424; 250/427; 250/288; 313/359.1; 313/361.1; 313/362.1; 315/111.81

[58] Field of Search ..... 250/423 R, 424, 425, 250/427, 288; 313/359.1, 361.1, 362.1; 315/111.81

[56] References Cited

U.S. PATENT DOCUMENTS

| | | | |
|---|---|---|---|
| 2,697,788 | 12/1954 | Wilson | 250/425 |
| 3,076,112 | 1/1963 | Wasserman | 313/63 |
| 3,305,696 | 2/1967 | Kilpatrick | 315/111 |
| 3,424,904 | 1/1969 | Donnally | 250/84 |
| 3,767,952 | 10/1973 | Ormrod | 313/63 |
| 3,778,656 | 12/1973 | Fremiot et al. | 313/63 |
| 4,377,773 | 3/1983 | Hershcovitch et al. | 315/111.81 |
| 4,468,564 | 8/1984 | Boyer et al. | 250/427 |

OTHER PUBLICATIONS

Henkelman et al., J. Phys. E7, 176 (1974).

*Primary Examiner*—Bruce C. Anderson
*Assistant Examiner*—Jack I. Berman
*Attorney, Agent, or Firm*—Paul F. McCaul; John R. Manning; Thomas H. Jones

[57] ABSTRACT

An electron gun is used with a mirror electrostatic field to produce zero or near zero velocity electrons by forming a turning point in their trajectories. A gas capable of attaching zero or near zero velocity is introduced at this turning point, and negative ions are produced by the attachment or dissociative attachment process. Operation may be continuous or pulsed. Ions thus formed are extracted by a simple lens system and suitable biasing of grids.

12 Claims, 5 Drawing Figures

GENERATION OF INTENSE NEGATIVE ION BEAMS

ORIGIN OF INVENTION

The invention described herein was made in the performance of work under a NASA contract, and is subject to the provisions of Public Law 96-517 (35 USC 202) in which the Contractor has elected not to retain title.

BACKGROUND OF THE INVENTION

This invention relates to a method and apparatus for the generation of atomic and molecular negative ion beams, either pulsed or continuous beams.

The production of beams of atomic and molecular negative ions is of considerable interest in diverse areas of atomic, molecular, and plasma physics. Such beams are required for fusion plasma heating, heavy ion inertial-confinement fusion, and in basic atomic and molecular scattering studies. The types of sources for ion production are many and varied, involving both plasma and surface-plasma interactions.

SUMMARY OF THE INVENTION

In accordance with the present invention, an ion source utilizes a beam of electrons and target molecules. The source includes an electrode which reverses the electron beam, producing electrons at their turning point having a distribution of velocities centered at zero velocity. A gas which attaches zero velocity electrons or some near-zero velocity electrons is introduced at or near this turning point. Negative ions of the gas are produced by an attachment, or a dissociative attachment, process. For many of the thermal electron-attaching molecules, the attachment cross section at zero electron energy can be quite large, varying as (electron energy)$^{-\frac{1}{2}}$, or just the s-wave threshold law.

The novel features of the invention are set forth with particularity in the appended claims. The invention will best be understood from the following description when read in conjunction with the drawings.

DESCRIPTION OF PREFERRED EMBODIMENTS

In the following description, the cross sections referred to are "attachment cross sections" defined in the usual sense of the probability per molecule that an electron traversing a gas will undergo an attaching collision with the gas molecules.

Figure 1:
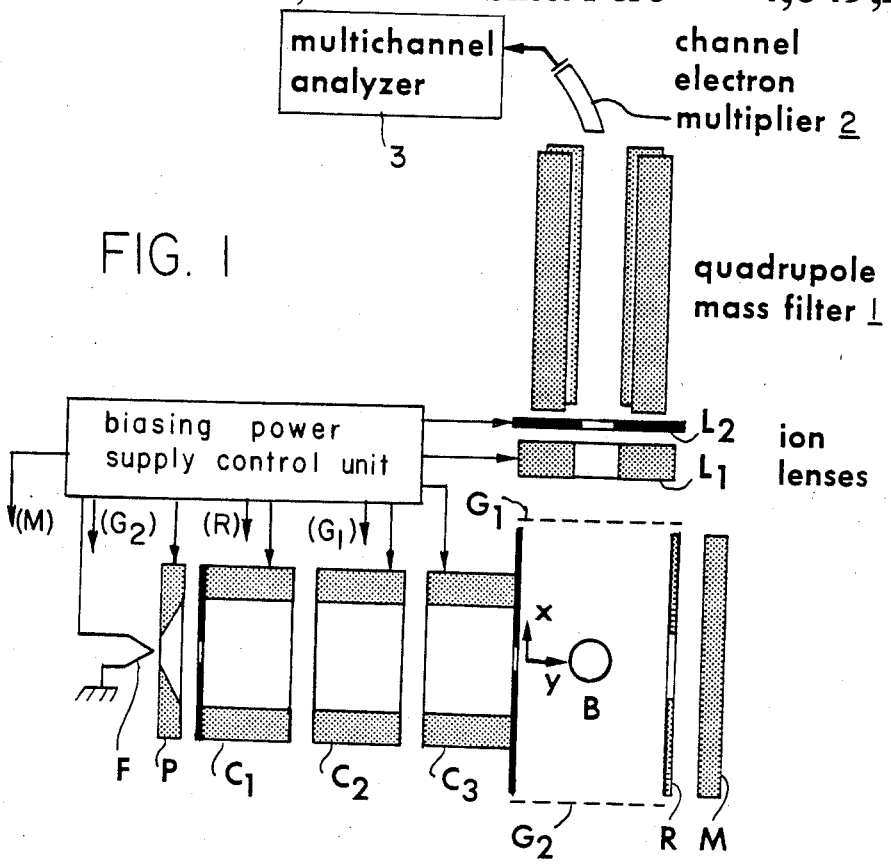
FIG. 1 is a schematic diagram of the apparatus and method for generation of intense beams of negative ions by zero-energy electron attachment, or dissociative attachment, in accordance with the present invention.

Many molecules, such as $SF_6$, $CFCl_3$, perfluorinated carbon compounds, and chlorocarbon compounds, have extremely large cross sections for attachment of zero-energy electrons to form negative ions such as $F^-$, $Cl^-$, $Br^-$, and $I^-$. In conventional ion sources, electron energies are too high (of the order 2–3 eV or greater) to attach to these molecules. In the apparatus of the present invention, "zero energy" electrons are generated momentarily by pulsing a reversing electrode R negatively with respect to an electron-gun cathode F,P. In this preferred embodiment, the reversing electrode is comprised of a conductive ring R and a conductive mirror plate M. These electrons can then attach to molecules, such as $CFCl_3$, which effuse from a 1 mm diameter stainless-steel tube B placed at the center of the electrostatic reversal field. This field is produced by applying appropriate negative potential on the ring R and mirror M. The location of the electron turning point is governed by the magnitude of potentials on the electrodes R and M. Applying larger negative potentials $E_R$ and $E_M$ has the effect of moving the turning point to the left in FIG. 1, and vice versa. The "mirror" effect produced by the ring R and mirror M can be either concave, convex or planar, depending upon the potential ratio. However, the invention is not limited to such an arrangement of these electrodes R and M as the "reversing electrode" for production of zero energy electrons.

The present invention takes advantage of the extremely large, threshold (zero-energy) electron attachment cross sections in several molecules to generate, for example, intense beams of $F^-$, $Cl^-$, $Br^-$ and $I^-$ ions. Thus, an ion source is provided in which an electrode or grid, which reverses electron trajectories, is placed just beyond an ion extraction aperture comprised of ion lenses $L_1$ and $L_2$. When the reversing electrodes are pulsed negatively, this pulse voltage reverses the direction of electrons momentarily, giving the electrons zero kinetic energy. At this zero-energy turning point the electrons attach to the ambient gas, and generate negative ions as the product of the attachment process. The method described herein as an example is applied to the generation of $Cl^-$ ions from $CFCl_3$. Other ions from effusing molecules may be formed and extracted through the aperture formed by the ion lenses $L_1$ and $L_2$ in the same manner.

Recent experimental evidence has shown that the zero-energy cross section to $CFCl_3$, $SF_6$, $CCl_4$, and other molecules is much larger than previously expected. Thus, the probability of electron attachment during the field-reversal pulse will be much larger, making this apparatus an even more efficient ion source. Generally, the production yield of negative ions is the product of the electron energy distribution function and the dissociative attachment cross section, integrated over all electron energies. The reversing electrode momentarily creates a maximum in the distribution function at the maximum of cross section (zero eV), thus maximizing the integral and therefore the yield of negative ions.

The electrons in the turning point region B will have a peak at about zero eV in their energy distribution. These electrons can then attach to an admixed gas having a peak in its dissociative attachment (DA) cross section at zero eV. $Cl^-$ was generated as an example from $CFCl_3$ for several reasons: the behavior of the cross section for $Cl^-$ production at zero eV (greater than $10^{-13}$ cm$^2$) is now well known, and is many orders of magnitude greater than for $H^-$ production from $H_2$ at higher energies, an effect due to the divergent nature of the s-wave attachment cross section; $Cl^-$ is by far the major ion produced in $CFCl_3$ at any electron energy; and $CFCl_3$ is inexpensive and inert.

Other examples of the effect of reversal of electron trajectories is seen in a high-pressure electron swarm and the diffuse discharge plasmas. Electrons in a swarm, for example are backscattered by elastic and inelastic gas collisions. These electrons move against the drift field until their trajectories are reversed, and are accelerated along the field lines again. At their turning point, they have essentially zero kinetic energy, and can be removed from the swarm by attachment to $SF_6$, $I_2$, or an admixed perfluorocarbon compound.

The overall process can be described, for molecules AB and electron energy E, as $$e(E \sim OeV) + AB \rightarrow AB^- \text{ (attachment)} \quad (1)$$
$$e(E \sim OeV) + AB \rightarrow A + B^- \text{ (dissociative attachment)}$$

From the Wigner threshold law, the cross section to form the atomic ions $Cl^-$ or $F^-$, or the corresponding parent negative ions, behaves as $E^{-\frac{1}{2}}$ in the limit $E \rightarrow 0$, thus providing an extremely efficient path for negative ion formation. Use of $CFCl_3$ had the additional virtue that the cross section for $Cl^-$ production greatly exceeded that for production of other possible ions ($F^-$, $Cl_2^-$, and $CCl_3^-$) at energies below 3 eV. This situation arises in other molecular targets as well, and makes for an efficient source with minimal interference from other species during extraction and acceleration in an ion beam transport system.

The theoretical calculation of Henkelman and Ottensmeyer, J. Phys. E7, 176 (1974), is used to fix the placements of the $C_3$, M, and R electrodes, and to determine the aperture diameters in $C_3$ and R. The distance between $C_3$ and R was 9.8 mm in our experiments.

Assuming the origin as the center of the aperture in $C_3$ and neglecting aberrations in the reversal field, the longitudinal energy $E_y$ and transverse energy $E_x$ are $$E_y = E_{0y} - e|\epsilon \cdot y|$$
$$E_x = E_{0x}, \quad (2)$$

where $\epsilon$ is the electric field intensity, and $E_{0x}$ and $E_{0y}$ ($E_0 = E_{0x} + E_{0y}$) refer to launched values of electron energy at the origin. The total energy at any location is $E = E_x + E_y$ and diminishes with increasing electron penetration into the field. The mean transverse energy $E_x$ is $E_0 \sin^2 \theta$, where the $\theta$ is the mean divergence angle in the electron gun. The particular case chosen in $E_y = 0$ located at $y = |E_{0y}/e\epsilon|$, although one may choose other energies as well.

The grids $G_1$ and $G_2$ serve to extract out of the reversal field the negative ions (here $Cl^-$) generated. The bias on $G_1$ is positive, and that on $G_2$ negative relative to ground. The extracted ions are accelerated by several lenses formed by electrodes $L_1$ and $L_2$, and focused at the entrance aperture of a utilization device (here a quadrupole mass filter 1 tuned to the mass of the particular negative-ion fragment in the experiments). After mass filtering the ions are accelerated to 1 keV into a channel-type electron multiplier 2. The output of the multiplier is amplified, and stored by multichannel analyzer 3 as a function of either sweep voltage on the ring element R, or as a function of incident electron energy $E_0$. The base pressure of the vacuum system (about $2 \times 10^{-5}$ Pa) rose to a background pressure of $2 \times 10^{-3}$ Pa during operation.

The extraction of $Cl^-$ ions may be carried out in either a continuous or pulsed mode. In the case of continuous operation, steady-state potentials are applied to the electron gun element $C_1$ and extracting electrodes $G_1$,$G_2$. In practice there is negligible penetration of the $G_1$, $G_2$ fields into the region B so that ions extracted in this way are very likely only a small part of the total ion production in the turning point region.

Figure 2:
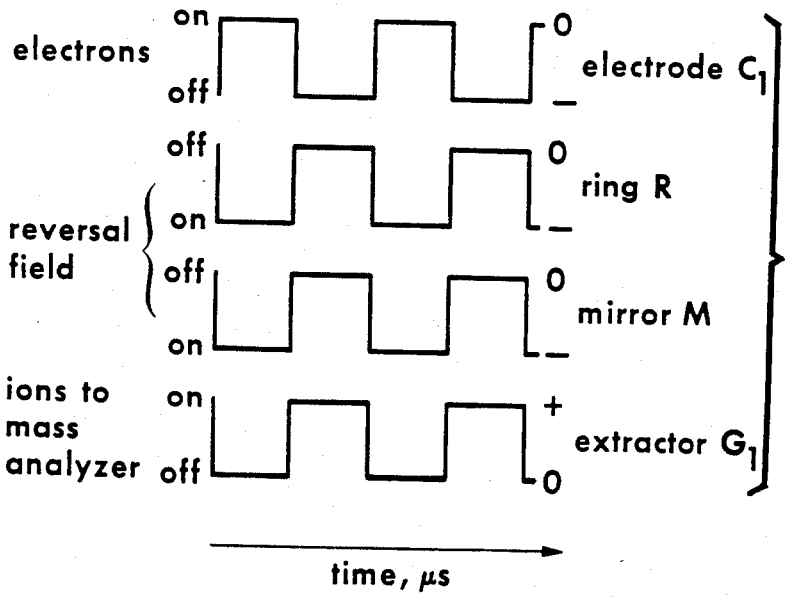
FIG. 2 illustrates the grid pulsing sequence for pulsed operation of the source shown in FIG. 1.

In pulsed operation ions are formed by applying the appropriate potentials to elements $C_1$, R and M to turn the ion beam on, and reverse it in the region B, for periodic intervals, and then applying the appropriate potential at a grid $G_1$ for extraction of the negative ions while the electron beam and reversal field are pulsed off. The sequence of applied pulses is shown in FIG. 2. Elements $G_1$ and $G_2$ are held at ground potential during the ion generation interval. The $Cl^-$ ions are created via a dissociative attachment process $e(E \sim 0 \text{ eV}) + AB \rightarrow A + B^-$ in this step. The electron gun is then pulsed off by applying a $-100$ V potential to electrode $C_1$ and grounding the mirror M and ring R. A positive pulse is applied to grid $G_1$ to extract the $Cl^-$ ions (while a negative pulse is applied to grid $G_2$). These ions are extracted through an aperture formed by ion lenses $L_1$ and $L_2$, and mass analyzed. For these experiments, the ion pulses from the channel-type detector were routed to the multi-channel analyzer where the ion signal is stored as a function of $E_0$, or the ring and mirror voltages, as part of an experimental test of the invention.

Experimental Results

We have measured the negative ion yield as a function of ring potential at incident electron energies $E_0$ of 20, 30, 40, 50, 60 and 80 eV. In the case of continuous operation the mirror potential $V_m$ at each energy was just $-E_0/e$ (where e is the magnitude of electron charge) and the potential $V_R$ on R was obtained from the calculations of Henkelman and Ottensmeyer, supra for the ratio $V_R/V_M$.

Figure 3:
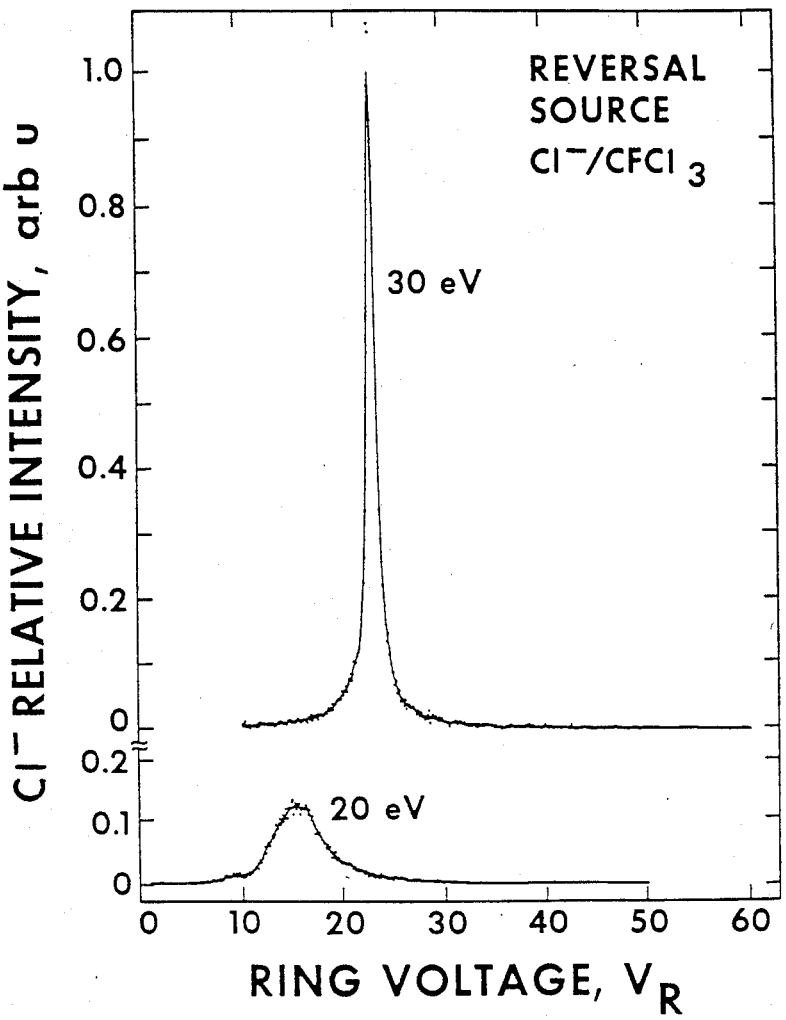
FIG. 3 illustrates the relative $Cl^-$ yields for continuous operation of the source shown in FIG. 1 as a function of the ring potential $V_R$, and at electron energies $E_o$ of 20 eV and 30 eV.
Figure 4:
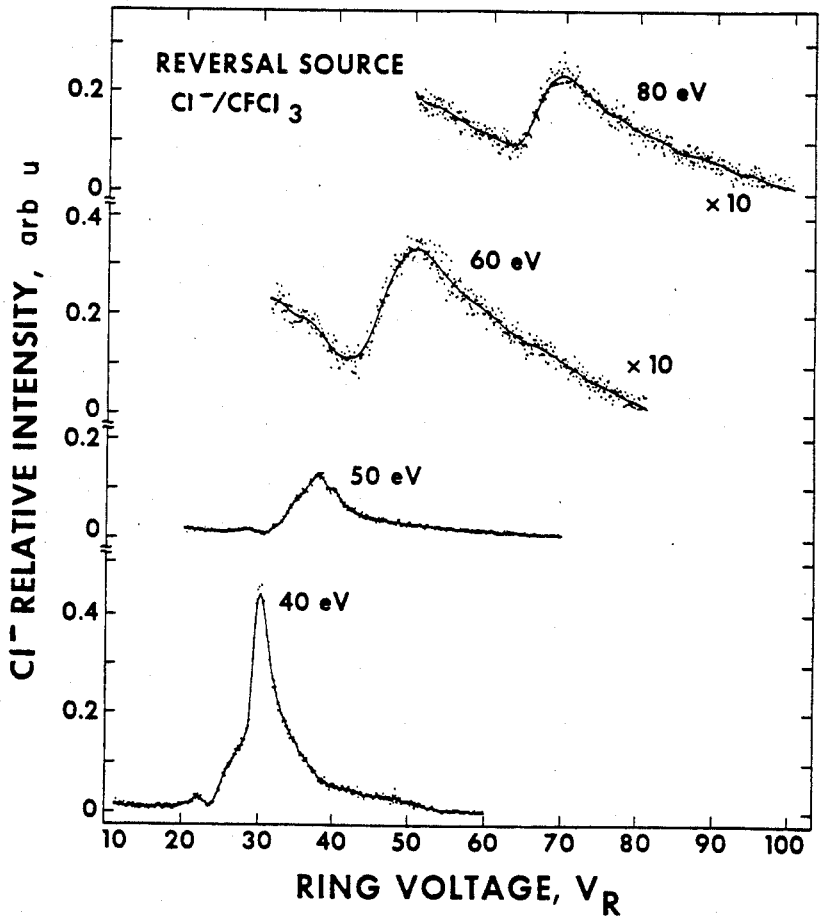
FIG. 4 illustrates the relative $Cl^-$ yields for continuous operation at 40, 50, 60, and 80 eV electron energies.

Results of $Cl^-$ signal vs $V_R$ for continuous-mode operation are shown in FIGS. 3 and 4 at the indicated $E_0$. It is clear from these spectra that, as expected, increasingly greater ring voltages $V_R$ are required to reverse increasingly energetic electron (higher $E_0$). Also, the highest signal count rates and narrowest widths were encountered as $E_0 = 30$ eV. While this effect of width is not clearly understood, several effects which could give rise to this behavior with $E_0$ are: optimum electron-molecule spatial overlap (e.g., focusing at region B the smaller "disk of least confusion" rather than the Gaussian image), a minimal transverse energy $E_x$, thus bringing more electrons into the peak of the attachment cross section at zero electron energy (see Eq. 2), minimal aberrations in the reversal field, or optimal extraction and focusing efficiency by $G_1$, $L_1$, and $L_2$.

All count rates in FIGS. 3 and 4 are given relative to the 30 eV count rate, so that relative efficiencies at the different energies can be compared. In the following table we list at each energy the peak counting rate, integral counting rate, and the mirror ratio $V_{Rmax}/V_M$ corresponding to the peak signal.

| Incident Electron Energy $E_o$ (eV) | Maximum Counting Rate ($10^2$/sec) | Integral Counting Rate ($10^4$/sec) | $\frac{V_{Rmax}}{V_M}$ |
|---|---|---|---|
| 20 | 2.2 | 1.6 | 0.75 |
| 30 | 18.0 | 3.2 | 0.75 |
| 40 | 7.6 | 5.2 | 0.75 |
| 50 | 5.7 | 2.5 | 0.75 |
| 60 | 0.58 | 1.4 | 0.81 |
| 80 | 0.47 | 1.1 | 0.87 |

Figure 5:
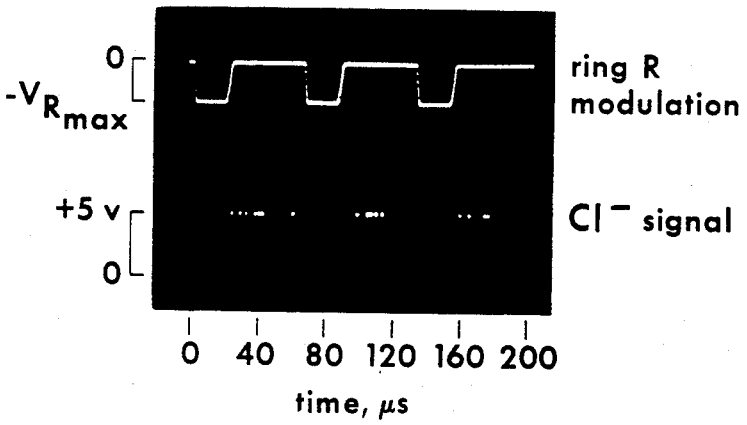
FIG. 5 illustrates the distribution of $Cl^-$ pulses during several pulsing cycles of the ring electrode voltage $V_{Rmax}$.

For pulsed operation of the source described hereinbefore with reference to FIG. 2 there is shown in FIG. 5 an oscilloscope image of the distribution of $Cl^-$ pulses during several cycles of the ring voltage $V_{Rmax}$. The electron energy is 40 eV and the value $V_{Rmax}/V_M$ is 0.75. The maximum yield and peak-integrated yield for this pulsed operation is found to be about ten times greater than for continuous operation, even after a 30% duty cycle is taken into account. This increase is almost certainly due to the fact that $Cl^-$ ions are now being extracted from a field-free region, and not from the field of the ring and mirror which tends to drive the ions from the turning point region back toward $C_3$.

Efficiency

The production rate I of $Cl^-$ ions can be written as $$I(Cl^-)(s^{-1})=NV\phi\sigma_A(E), \quad (3)$$

where $N(cm^{-3})$ is the $CFCl_3$ target density, $V(cm^3)$ the overlap volume between the electron and target beams, $\phi(s^{-1}\,cm^{-2})$ the incident electron flux, and $\sigma_A(E)(cm^2)$ the attachment cross section at $E\sim 0$ energy. Estimates of the quantities in Eq. (3) are as follows: A pressure of $CFCl_3$ in the beam was taken as 0.133 Pa, or $N\sim 3.3\times 10^{-}cm^{-3}$. The interaction volume is taken as that of a cylindrical electron beam of 0.2 cm diameter intersecting a target beam of 0.2 cm diameter, or $V\sim 6.3\times 10^{-3}\,cm^3$. The electron flux is taken as a 1.5 $\mu$A electron beam in a cylinder of 0.2 cm diameter or $3.0\times 10^{14}\,s^{-1}\,cm^{-2}$, and an average attachment cross section is taken as $2\times 10^{-14}\,cm^2$ for E less than approximately 0.1 eV. Assuming that the entire 1.5 $\mu$A incident current is reversed to give a sum of longitudinal and transverse energies E of less than about 0.1 eV, then the production rate $I(Cl^-)$ is $1.2\times 10^{12}\,s^{-1}$, or 0.2 $\mu$A. Thus, it appears that 13% of the incident electron beam can be converted to $Cl^-$. This corresponds to a current density $\rho$ of $\rho\sim 0.2\,\mu A/3\times 10^{-2}=6.7\,\mu A/cm^2$ for emission from a 0.2 cm diam region of the target. This density can be increased by several orders of magnitude through use of (a) more intense electron beams (milliamperes or amperes as opposed to microamperes currently used) with a correspondingly larger beam size, and (b) denser targets.

It should also be possible to extend the use of the source to the generation of negative ions through attachment resonances located at nonzero electron energies, since a continuous distribution of electron energies exists between $C_3$ and R. While for the present demonstration of the source we have chosen $E_y=0$, one can choose (see Eq. 2) any other energy $E'_y$ located at the same y, but at a value of $$\epsilon'=|(E_{0y}-E'y)/ey| \quad (4)$$

This energy could correspond, for example, to the 3.7 $eV^2\Sigma_u$ resonance in $H_2$ to produce $H^-$. Moreover, any given energy $E'_y$ is attained twice: once when $\epsilon'$ and y are parallel (electrons decelerating towards the turning point), and once when antiparallel (electrons accelerating away from the turning point). Thus, the electron beam is "used" twice.

What is claimed is:

1. A method for generating negative ions using a beam of electrons comprising the steps of:

producing an electric field in the path of said electron beam for reversal of said electron beam to produce at the turning point electrons having a distribution of energies centered at zero;

introducing a gas containing thermal electron-attaching molecules at a point in the path of said electron beam where said electrons have a low energy and a high probability for attachment to said molecules, thereby efficiently generating ions; and directing said ions in a focused beam to a utilization device.

2. A method as defined in claim 1 for generating negative ions from thermal electron-attaching molecules having an extremely large attachment cross section at zero electron energy wherein said gas of said molecules is introduced at said turning point.

3. A method as defined in claim 1 for generating negative ions from thermal electron attaching molecules having an attachment cross section at a level near zero electron energy wherein said gas of said molecules is introduced at a point in the path of said electron beam ahead of said turning point, whereby said electrons of the appropriate energy make two passes through said gas of said molecules for enriched ion generation.

4. A method as defined in claim 1 wherein said electric field is controlled to be constant for continuous generation of ions.

5. A method as defined in claim 1 wherein said electric field is controlled for pulsed generation of ions.

6. A method as defined in claim 5 wherein said control of said electric field for pulsed generation of ions includes pulsed gating of said beam of electrons to said turning point and simultaneously pulsing said reversal of said electron beam while said electron beam is gated on, and directing said ions to said utilization device while reversal of said electron beam, and the generation of said electron beam, are pulsed off.

7. A negative ion source comprising:

means for generating a beam of electrons, electrodes in the direct path of said beam;

means for biasing said electrodes for reversal of said electron beam to produce at the turning point electrons having a distribution of energies centered at zero;

means for introducing a gas containing thermal electron-attaching molecules at a point in the path of said electron beam where said electrons have low energy and a high probability for attachment to said molecules, thereby efficiently generating ions; and means for directing said ions in a focused beam to a utilization device.

8. Apparatus as defined in claim 7 for generating negative ions from thermal electron-attaching molecules having an extremely large attachment cross section at zero electron energy wherein said gas of said molecules is introduced at said turning point.

9. Apparatus as defined in claim 7 for generating negative ions from thermal electron-attaching molecules having an attachment cross section at a level near zero wherein said gas of said molecules is introduced at a point in the path of said electron beam between said electron gun and said turning point, whereby said electrons of the appropriate energy make two passes through said gas of said molecules for enriched negative ion generation.

10. Apparatus as defined in claim 7 wherein said biasing means is controlled with constant voltages for continuous generation of ions.

11. Apparatus as defined in claim 7 wherein said biasing means is controlled for pulsed generation of ions.

12. Apparatus as defined in claim 11 wherein said control of said biasing means for pulsed generation of ions is comprised of means for pulsed gating of electrons to said turning point and simultaneously pulsing said electrodes for reversal of said electron beam while said electron beam is turned on, and turning on said means for directing said ions to said utilization device while said electrodes for reversal of said electron beam, and said electron beam, are pulsed off.

* * * * *